United States Patent [19]

Ogunbiyi et al.

[11] Patent Number: 4,690,773

[45] Date of Patent: Sep. 1, 1987

[54] MICROBIAL ENZYMATIC CONTACT LENS CLEANER AND METHODS OF USE

[75] Inventors: Lai Ogunbiyi, Fairport; Francis X. Smith, Walworth, both of N.Y.

[73] Assignee: Bausch & Lomb Incorporated, Rochester, N.Y.

[21] Appl. No.: 861,741

[22] Filed: May 7, 1986

Related U.S. Application Data

[63] Continuation of Ser. No. 690,372, Jan. 9, 1985, abandoned, which is a continuation of Ser. No. 545,315, Oct. 24, 1983, abandoned.

[51] Int. Cl.[4] ..... B08B 3/08

[52] U.S. Cl. ..... 252/174.12; 252/DIG. 12; 435/264

[58] Field of Search ..... 252/174.12, DIG. 12; 435/264

[56] References Cited

U.S. PATENT DOCUMENTS

| | | | |
|---|---|---|---|
| 3,220,928 | 7/1962 | Brenner | 435/264 |
| 3,574,120 | 4/1971 | Siebert et al. | 252/132 |
| 3,855,142 | 12/1974 | Pader et al. | 252/135 |
| 3,962,107 | 6/1976 | Levin et al. | 252/100 |
| 4,011,169 | 3/1977 | Diehl et al. | 252/95 |
| 4,021,377 | 5/1977 | Borchert et al. | 252/546 |
| 4,048,122 | 9/1977 | Sibley et al. | 222/544 |
| 4,065,324 | 12/1977 | Rankin | 134/30 |
| 4,096,870 | 6/1978 | Manfuso, Jr. | 252/136 X |
| 4,104,187 | 8/1978 | Sibley et al. | 252/364 |
| 4,126,587 | 11/1978 | Sibley et al. | 252/541 |
| 4,155,868 | 5/1979 | Kaplan et al. | 252/95 |
| 4,285,738 | 8/1981 | Ogata | 252/174.12 X |
| 4,395,346 | 7/1983 | Kleist | 252/135 |
| 4,515,705 | 5/1985 | Moeddel | 252/174.12 |
| 4,521,254 | 6/1985 | Anderson et al. | 252/DIG. 12 |

FOREIGN PATENT DOCUMENTS

| | | |
|---|---|---|
| 0005131 | 10/1979 | European Pat. Off. . |
| 1577524 | 10/1980 | United Kingdom . |

OTHER PUBLICATIONS

Chemical Abstracts, vol. 73, No. 14, Oct. 5, 1970, No. 73267j, "Effect of Some Proteases on Bovine Crystalline Lens; In Vitro Study".

Lo, Journal of the American Optometric Association, vol. 40, No. 11, pp. 1106–1109, Nov. 1969 (Already of record).

*Primary Examiner*—John E. Kittle

*Assistant Examiner*—Mukund J. Shah

*Attorney, Agent, or Firm*—Bernard D. Bogdon; Craig E. Larson

[57] ABSTRACT

Proteinaceous tear films and debris are removed from contact lenses with aqueous solutions of a protease derived from a Bacillus, Streptomyces, or Aspergillus microorganism. The solutions are substantially odor-free, non-allergenic, require no activator/stabilizer and are completely water soluble.

8 Claims, No Drawings

MICROBIAL ENZYMATIC CONTACT LENS CLEANER AND METHODS OF USE

This application is a continuation of application Ser. No. 690,372, filed Jan. 9, 1985, now abandoned, which is a continuation of application Ser. No. 545,315 filed Oct. 24, 1983, now abandoned.

BACKGROUND OF THE INVENTION

The present invention relates generally to lens cleaning compositions and methods of use. More specifically, this invention is concerned with new enzyme cleaners and methods for effective removal of film build-up and debris from contact lenses which may be present as proteinaceous-carbohydrate-lipid containing deposits.

Cleaning compositions for contact lenses generally fall into one of three categories: surfactant cleaners; oxidative cleaners and enzyme cleaners. Surfactant cleaners are widely used, for example, by placing a drop of solution on a lens, rubbing the lens between the fingers followed by rinsing. Although such cleaners are usually safe and not harmful to lenses when used properly, most surfactant cleaners are not effective in the removal of protein deposits.

The second type of cleaning system involves oxidative products containing, for example, persulfates and perborates. They may be used either by cold soaking or with boiling for about 30 minutes. This type of cleaning system is mainly effective in removing non-protein deposits from contact lenses. They are generally nontoxic, ; however, oxidizing agents can have a deleterious effect on lenses. One possible explanation is that they may oxidize the basic polymer chain by the introduction of pH-sensitive molecular groups.

The third method of cleaning is with enzymes. Enzyme cleaners are generally viewed as being efficacious, safe and capable of removing the principal component of contact lens film and debris, namely protein. Some also have the ability to remove carbohydrate and lipid deposits from contact lenses.

Heretofore, the supply of proteolytic, carbolytic and lipolytic enzymes e.g. . . . proteases, amylases and lipases for use in contact lens cleaning solutions was restricted to plant and animal sources. Cleaning solutions prepared from plant and animal derived enzymes have several shortcomings. In most instances, they either impart an unpleasant odor to the cleaning bath or develop an odor after a few hours of use. In some cases, plant and animal proteases and amylases will discolor lenses.

Contact lens cleaning solutions prepared with plant and animal derived proteases like papain, chymopapain, pancreatin, trypsin, chymotrypsin, pepsin, ficin, carboxypeptidase, aminopeptidase, and bromelin are described in several patent publications e.g. . . . U.S. Pat. No. 3,910,296; U.K. Patent Publication GB No. 2,088,851; Japanese application No. 113,233 published May 31, 1975 as Kokai 64,303 and U.S. Pat. No. 4,096,870. In addition to the patent citations, enzymatic lens cleaners prepared with proteases from pork, namely pancreatin have been commercially available from Alcon Laboratories. Enzymatic contact lens cleaners prepared with plant proteases i.e. papain have also been available from Allergan Pharmaceuticals under the registered trademark Soflens Enzymatic Cleaning Tablets. Although these preparations are generally effective in cleaning contact lenses, they have shortcomings in addition to those previously mentioned. That is, besides the propensity for unpleasant odors and potential for discoloring lenses, cleaners containing proteases like pancreatin from pork or beef can induce an allergic response among some users. In addition, solutions containing pancreatin have a tendency to become cloudy and turbid.

Plant proteases, for example papain, normally require lengthy cleaning cycles ranging from 4 to 12 hours in order to remove film and debris from lenses. Such lengthy cycles can be an inconvenience to the user. In addition, cleaning solutions prepared with plant and animal proteases require the application of heat e.g. 80° C. which is needed not only to disinfect the lenses, but also to inactivate the enzyme.

Contact lens cleaners containing enzymes also require stabilizers/activators. For example, papain requires cysteine. Pancreatin requires calcium salts. Without the use of an activator papain and other similar plant enzymes will remain dormant. Activators like cysteine are hygroscopic and have a tendency to pick-up moisture creating manufacturing difficulties. Such enzyme products can only be manufactured and packaged under stringent standards to eliminate any moisture from entering the packaging otherwise it will autoreact and shorten the shelf life of the cleaner.

Microbial proteases derived from Bacillus and Streptomyces bacteria and Aspergillus mold have been previously described. U.S. Pat. No. 3,590,121 discloses an effervescent tablet used for making mouthwash. The tablets and solutions of this patent employ a neutral protease referred to as a metallo-enzyme having an optimum activity at a pH of 6 to 8. Because metals are an integral part of the enzyme, its activity is inhibited by the presence of chelating agents which are customarly employed in contact lens cleaning preparations to bind calcium and other unwanted metals from reacting with proteins and depositing on lenses. Consequently, enzymes which are inhibited by chelating agents, like those described in U.S. Pat. No. 3,590,121 are generally unsatisfactory for use with contact lenses.

U.S. Pat. No. 3,717,550 describes the preparation of liquid concentrates of bacterial protease and/or amylase. The liquid concentrates are used for making such products as household detergents.

Accordingly, there is a need for safer, more dependable enzyme cleaning preparations which will offer a broad spectrum of cleaning capability for efficient removal of at least protein and carbohydrate films and debris from contact lenses. The enzymes should be both stable in solution, remain active at elevated temperatures and be compatible with other components of the cleaning composition. Preferably, the enzyme system should not depend on the use of activators which may lead to autodigestion with the enzyme, limiting the shelf-storage life. Similarly, the cleaning process should be convenient for the user eliminating the need for protracted soaking periods by allowing the user the flexibility of shorter cleaning times. The enzyme cleaning composition should also be free or substantially free of odor and not cause discomfort to the wearer when the lenses are reinserted into the eyes. They should not cause irritation or allergic response as a result of residual amounts of enzyme on the lens surface.

SUMMARY OF THE INVENTION

In accordance with this invention, there is provided an enzymatic contact lens cleaner containing an effective, non-toxic amount of a protease derived from a Bacillus, Streptomyces or Aspergillus microorganism, such that when dissolved in an aqueous solution will effectively remove at least protein and carbohydrate films and debris from contact lens surfaces. The enzyme cleaners may contain protease alone derived from the above genera of bacteria or mold. The enzyme(s) will preferably be comprised of a mixture predominantly of protease and amylase, and optionally, a minor amount of lipase.

This invention also contemplates various tablets including effervescent and non-effervescent water soluble tablets, including granules and powders which contain in addition to the usual inert binders, excipients, lubricants etc., other desirable functional additives, like buffers, preservatives, chelating agents, tonicity adjusters, and the like, such that when dissolved in water a preserved isotonic solution is formed and ready to be used for lens cleaning. Similarly, the present invention contemplates water-soluble microbial protease-amylase tablets particularly suitable as heat unit enzyme tablets for high temperature cleaning/disinfection of lenses. Such tablets may be added to aqueous isotonic lens soaking or cleaning solutions for cold soaking or high temperature cleaning and disinfecting. These soaking and cleaning solutions which the enzyme tablets are added to may contain preservatives, chelating agents, surfactants, pH buffers, tonicity adjusters, etc.

The microbial protease-containing lens cleaning solutions are especially effective in digesting and removing denatured protein and carbohydrate films and debris from contact lenses without enzyme activators, and therefore, present fewer manufacturing and packaging problems in formulating the various cleaning preparations contemplated herein.

The enzymatic contact lens cleaners of the present invention are especially effective in removing contact lens film and debris in one hour or less by high temperature cleaning methods. In addition, the bacterial enzyme cleaners may perform with little or no residual binding or concentrating onto lens surfaces, and therefore, eye tissue sensitivity normally manifested as stinging and inflammation are virtually eliminated.

DESCRIPTION OF THE PREFERRED EMBODIMENTS

This invention relates to cleaning solutions for use with most contact lenses, including hard and soft lenses, as well as the newer hard gas permeable type contact lenses, such as described in U.S. Pat. No. 4,327,203. The invention also relates to those soft lenses generally referred to as extended-wear lenses containing 55 percent or more water content. The term "soft contact lens" as used herein generally refers to those contact lenses which readily flex under small amounts of force and return to their original shape when that force is released. Typically, soft contact lenses are formulated from poly(hydroxyethyl methacrylate) which has been in the preferred formulations, cross-linked with ethylene glycol dimethacrylate. For convenience, this polymer is generally known as PHEMA. Soft contact lenses are also made from silicon polymers cross-linked, for example, with dimethyl polysiloxane. Conventional "hard contact lenses", which cover only the cornea of the eye, usually consist of poly(methyl methacrylate) cross-linked with ethylene glycol dimethacrylate.

The enzyme cleaners are derived from microorganisms and include various species of Bacillus and Streptomyces bacteria and Aspergillus mold. Species of microorganisims within the foregoing genera known to form mainly protease and amylase are intended and include such members as *B. subtilis, B. licheniformis, Aspergillus oryzae, Aspergillus niger, Streptomyces griseus, Streptomyces naraenia.* Protease and amylase derived from *B. licheniformis* are generally preferred. The compositions herein may contain only protease, but microbial enzymes in pure or nearly pure form are not always readily available. Thus, most commercially available products containing mixtures predominantly of protease and then amylase, including some lipase are satisfactory. The amylase is preferably $\alpha$-amylase because $\beta$-amylase is more sensitive to heat.

The microbial enzyme products contemplated herein are commodities of commerce and are readily available from a number of manufacturers under various designations. For instance, Enzyme Development Corporation, Keyport, N.J. produces protease under the Enzeco trademark including a food grade of protease, "PROTEASE AP I" derived from *B. licheniformes* which also contains $\alpha$-amylase activity. Fungal protease produced from *Aspergillus oryzae* is also available under the Enzeco trademark. Fungal protease is also available from Corning BIO Systems, Corning, N.Y. under the Rhozyme 41 trademark. Rhozyme P-11 a protease derived from *Aspergillus flavus-oryzae* is also available. Protease under the Rhozyme family of products include those grades designated as B-6; PF; and P-53 produced from *B. subtilis.* Useful proteases are also commercially available from the International Enzyme Company, Nagoya, Japan under the trademarks Amano; Prozyme and Newlase, and from G.B. Fermentation Industries, Des Plaines, Ill. under the trademarks Maxatase and Prolase.

The protease should be active at a pH range of from 5 to about 8.5. The optimum given pH for a given enzyme product may be above or below this range. But, because of the most preferred safe range for cleaning contact lenses is about the neutral range the importance of proteolytic activity in the highly alkaline and acidic pH ranges is not critical.

Preferably, the protease should not be inhibited when in the presence of a chelating agent, such as in the case of metallo-enzymes. Protease activity according to this invention may be expressed in casein units and is determined by the widely known procedure involving the digestion of casein. The procedure for assay of neutral protease activity is described in the Journal of General Physiology, 30 (1947) 291 and Methods of Enzymology, 2, Academic Press, N.Y. 33 (1955).

The enzymes preferably remain active when exposed to elevated temperatures. That is to say, the methods disclosed herein provide for cleaning lenses at ambient temperature conditions using the "cold" soaking technique, as well as elevated temperature conditions using high temperature cleaning/disinfection methods.

The enzymatic cleaners containing mainly the protease and amylase characterized hereinabove are employed in amounts sufficient to digest and remove films and debris from contact lenses. That is, the cleaning preparations should contain sufficient enzyme activity that when dissolved in the lens cleaning bath will remove virtually all proteinaceous and carbohydrate debris and film by either cold soaking or at elevated temperatures.

The enzyme concentration in solution will usually range from about 0.0001 and 5.0% w/v. Enzyme tablet preparations e.g. non-effervescent water soluble heat unit tablets, effervescent tablets, granules or powder packets will generally contain from about 0.01 to about 500 mg of enzyme, and more particularly, from about 10 to about 100 mg of enzyme wherein the protease activity ranges from about 30 to 80 casein units/mg of enzyme, and more preferably, about 40 to about 70 casein units /mg of enzyme.

As previously indicated, the present invention contemplates various premeasured compositions as convenient means for dispensing a sufficient amount of enzyme for cleaning lenses. They include, for example, soluble tablets which dissolve in aqueous solutions without effervescing; effervescent tablets including granules and powders each of which contain sufficient composition for a single cleaning cycle. Also included are large effervescent tablets which may be scored for easy fracturing whereby each half tablet can be used in making a cleaning solution for each lens placed in a lens case.

In preparing powders and various tablets the enzyme powder is formulated with known tablet binders or excipients and may have inert carriers, disintegrants and salts which will effervesce in aqueous solution. Methods and materials for making such tablets and powders are all well established practices in the tablet making art and their identification and selection are matters of routine skill.

In addition to the microbial enzymes, the tablets, granules and powders may also be formulated with one or more other ingredients to assure optimum cleaning activity without adverse affects to the lens or to the users' eyes. For example, the enzyme preparations may contain a variety of additives, such as tonicity adjusters, buffers, preservatives, surfactants, chelating agents to assure stability and sterility of the cleaning solution, complete dispersion of residual lipid deposits and the like. Enzymatic cleaning tablets and powders containing such complete formulations are highly convenient to the user, since a cleaning solution can be prepared by simply dissolving in distilled water. For example, tablets granules and powders may be formulated with tonicity agents to approximate the osmotic pressure of normal lacrimal fluids which is equivalent to a 0.9% solution of sodium chloride or 2.5% glycerol solution.

It may also be advantageous to include a disinfectant-/germicide as a means for preserving the cleaning solution. A preservative is added in sufficient amount to provide a concentration in the cleaning bath ranging from about 0.00001 to about 0.5 weight percent, and more preferably, from about 0.0001 to about 0.1 weight percent. Suitable preservatives include, but are not limited to thimerosal, sorbic acid, 1,5-pentanedial, alkyl triethanolamines, phenylmercuric salts, e.g. nitrate, borate, acetate, chloride and mixtures thereof. Other suitable compounds and salts may be used which are soluble in water at ambient temperature to the extent of at least 0.5 weight percent. These salts include the gluconate, the isothionate (2-hydroxyethanesulfonate), formate, acetate, glutamate, succinamate, monodiglycollate, dimethanesulfonate, lactate, diisobutyrate, glucoheptonate.

Suitable buffers include, for example, sodium or potassium citrate, citric acid, boric acid, sodium borate, sodium bicarbonate and various mixed phosphate buffers, including combinations of $Na_2HPO_4$, $NaH_2PO_4$ and $KH_2PO_4$. Generally, buffers may be used in amounts ranging from about 0.05 to about 2.5%, and more preferably, from about 0.1 to 1.5% by weight.

Complete tablets and powders preferably contain in addition to the tonicity agents, buffers and preservatives previously described, various sequestering or chelating agents to bind metal ions, such as calcium which might otherwise react with protein and collect on lens surfaces. Ethylenediaminetetraacetic acid (EDTA) and its salts (disodium) are preferred examples. They are normally added in amounts sufficient to provide a solution containing from about 0.01 to about 2.0 weight percent.

Although the microbial enzyme cleaning preparations described herein can be readily prepared with many of the above-identified additives, such that when dissolved in distilled water for example, will provide a complete, preserved isotonic-enzymatic cleaning solution, as a further preferred embodiment these tablets, powders, etc., may be prepared free of such additives, including tonicity agents, buffers, etc. That is, the various water soluble tablets, granules and powders may be formulated with suitable inert ingredients, such as carriers, lubricants, binders or excipients, like polyethylene glycol, sodium chloride etc., commonly used in the tablet making art. This embodiment is especially suitable for use in conjunction with other aqueous lens care products, like wetting solutions, soaking solutions, cleaning and conditioning solutions, as well as all purpose type lens care solutions. Such products contain, for instance, tonicity agents, pH buffers, cleaning and wetting agents, sequestering agents, viscosity builders, etc. Thus, effervescent tablets formulated, for example, with a mixture of the microbial enzymes and effervescent salts like citric or tartaric acids and sodium bicarbonate may be dissolved in any of the readily available OTC solutions e.g. . . . isotonic-preserved saline solution containing a chelating agent, such as disodium EDTA and a surfactant.

Microbial enzyme cleaning activity may be supplemented with a surfactant type cleaner which may be used before or after enzymatic cleaning to remove any residual lipid deposits. In those instances where there has been a heavy build-up of denatured tear film and debris on lenses the lipolytic activity of the enzyme may be supplemented by use of a surfactant-type lens cleaner. When surfactants are used, neutral or non-ionic types are preferred for their cleaning and conditioning properties which are usually present in amounts up to 15 weight percent. Examples of suitable surfactants include, but are not limited to polyethylene glycol esters of fatty acids, e.g. coconut, polysorbate, polyoxyethylene, or polyoxypropylene ethers of higher alkanes ($C_{12}$–$C_{18}$). Examples of preferred surfactants include polysorbate 20 (available under the trademark Tween 20), polyoxyethylene (23) lauryl ether (Brij ® 35), polyoxyethylene (40) stearate (Myrj ® 52) polyoxyethylene (25), propylene glycol stearate (Atlas ® 2612).

One non-ionic surfactant in particular consisting of a poly(oxypropylene)-poly(oxyethylene) adduct of ethylene diamine having a molecular weight from about 7500 to about 27,000 wherein at least 40 weight percent of said adduct is poly(oxyethylene) has been found to be particularly useful in cleaning and conditioning both soft and hard contact lenses in amounts from about 0.01 to about 15 percent. Such surfactants are available from BASF-Wyandotte under the registered trademark—Tetronic.

The microbial protease-amylase and optional lipase contact lens cleaners provide several benefits, including that they are substantially odor-free, are non-allergenic require no additional activator or stabilizer and are completely water soluble. In addition, the microbial protease-amylase enzyme cleaners may be conveniently used in conjunction with contact lens heat disinfection units, such as those available from Bausch & Lomb under the Aseptron trademark which has, for example, a one hour cleaning cycle where lenses in solution are heated up to about 80° C. and then allowed to cool. Thus, high temperature cleaning and disinfection may be carried out with the enzyme cleaners of the present invention in one hour or less without the usual 2 to 12 hour pre-soaking and final disinfection. The shorter cleaning cycles are especially desirable for use in conjunction with extended wear lenses which can be cleaned with the microbial protease/amylase product in 30 minutes at a peak temperature e.g. . . . 70° C., thereby reducing the possibility of physical damage, such as discloration to the lenses. Details of this one-step cleaning method are described in copending application Ser. No. 545,314, filed on even date herewith.

The following specific examples demonstrate the compositions and methods of the instant invention. It is to be understood that these examples are for illustrative purposes only and do not purport to be wholly definitive as to conditions and scope.

EXAMPLE I

In order to study the effectiveness of bacterial protease in removing proteinaceous film deposits and debris from contact lenses compressed, water-soluble heat unit tablets are first prepared with each tablet containing about 18 mg of PROTEASE AP I enzyme commercially available under the Enzeco trademark from Enzyme Development Corporation, Keyport, N.J. The enzyme is derived from *B. Licheniformis* and contains principally protease and α-amylase activity. The protease activity is approximately 53 casein units/mg. The enzyme is stable at a pH of between 5.0 and 10.0.

The enzyme powder is first granulated with a sufficient amount of a pharmaceutical grade polyethylene glycol (4000) or other suitable binder and lubricant. The granulated fines are then formed into compressed tablets with each tablet weighing approximately 30 mg.

EXAMPLE II

A clear artificial tear solution is prepared consisting of 0.2 grams of lysozyme/100 ml of electrolyte. The electrolyte is a stock solution prepared from sodium bicarbonate 2.2 gpl, sodium chloride 7 gpl, calcium chloride 0.0005 gpl and potassium chloride 1.5 gpl.

Six (6) polymacon soft contact lenses commercially available from Bausch & Lomb under the registered trademark Soflens are microscopically inspected before coating with the lysozyme solution. The lenses are then soaked in the lysozyme solution for 30 to 60 minutes at room temperature. The lenses are then placed individually into the wells of Lensgard® carrying cases and placed into Bausch & Lomb Aseptron® heat units in order to denature the lysozyme protein. The coated lenses are then placed in other Lensgard carrying cases and covered with sorbic acid preserved sterile isotonic saline solution containing Tetronic 1107 surfactant. A single tablet prepared in Example I is dispensed into each well of the carrying case and the caps for the cases tightly affixed. Each case is subjected to a heat cycle in a Aseptron heat unit having a one hour heating cycle with a maximum temperature of 80° C. followed by a cooling off cycle. At the conclusion of the heating cycle the lenses are removed from the cases rubbed and rinsed with sorbic acid preserved sterile isotonic solution containing Tetronic 1107 surfactant. Each of the lenses are then microscopically inspected. The denatured protein on all the test lenses is completely removed. No defects or apparent discolorations are observed in each of the six lenses.

EXAMPLE III

In order to evaluate the compatibility of the enzyme cleaning tablets on soft contact lenses a first experiment is conducted with the enzyme cleaner only. A second study is performed to evaluate the effects of the combination of the enzyme, preserved lens cleaner and heat on soft contact lenses.

Six (6) polymacon Soflens contact lenses are microscopically inspected for possible defects and discoloration and are then placed in the wells of three Lensgard lens carrying cases. Each of the lenses is then covered with a sorbic acid preserved isotonic saline solution containing Tetronic 1107 surfactant. Thirty (30) milligrams of polyethylene glycol is then added to the well of the first case; a water soluble enzyme tablet from Example I is placed in each of the wells of the second case and nothing further is added to the third carrying case. The caps for the wells are placed on each of the cases which are then subjected to a single one hour heating cycle in an automatic Aseptron heat unit.

The above procedure is repeated for five times using the same lenses while replenishing the preserved saline solution, polyethylene glycol and enzyme at the beginning of each of the cycles. At the conclusion of each of the cycles the lenses are microscopically inspected. No defects or discolorations are observed on any of the six lenses and the lenses remained unchanged for the duration of the study.

EXAMPLE IV

An occular irritation study is performed using fluorescein dye retention on corneas of rabbit eyes fitted with contact lenses treated in cleaning solutions prepared with the Enzeco AP heat unit enzyme tablets of Example I.

The eyes of three rabbits are fitted with Soflens brand polymacon contact lenses, three of which are cleaned by heating in an Aseptron heat unit containing the enzyme tablets from Example I dissolved in a sorbic acid preserved isotonic saline solution commercially available from Bausch & Lomb under the trademark Sensitive Eyes. The control eye is fitted with a lens heated with a Sensitive Eyes solution only. All eyes are examined macroscopically each day before insertion and after removal of the lenses which are worn on an average of six hours per day for five days. Fluorescein staining is performed in conjunction with U/V light prior to initiation of the study, repeated after three days of wear and again at the completion of the study. Any occular irritation is detected by dye absorption using slit lamp microscopy.

All eyes exhibit minimal conjunctival redness probably due to lens wear and manipulation. No positive fluorescein staining is observed. No positive reactions are observed macroscopically throughout the study.

EXAMPLE V

Comparative studies are conducted to evaluate the cytotoxicity of lens cleaning solutions prepared with the heat unit tablets of Example I. The studies utilize the Agar Overlay Assay technique published in the Journal of Pharmaceutical Sciences, Volume 54 (1965) pages 1545–1547 by W. L. Guess et al. Four polymacon Soflens contact lenses are soaked in solution prepared by dissolving enzyme tablets in the wells of Lensgard lens cases having sorbic acid preserved isotonic saline solution containing Tetronic 1107 surfactant. An additional four lenses are placed in cases containing only the preserved saline-Tetronic solution which serve as controls. The lenses are heated for one cycle in Aseptron heat units and rinsed in the preserved saline-Tetronic solution, then heat treated for an additional cycle and rinsed again before being plated onto L-929 mouse fibroblast cells to observe any lysing of the cells.

TABLE

| Lens | Solution | Response | Width of Decolorized Zone Percent of Cells Lysed |
|---|---|---|---|
| 1 | Enzyme | Non-cytotoxic | 0/0 |
| 2 | Enzyme | " | 0/0 |
| 3 | Enzyme | " | 0/0 |
| 4 | Enzyme | " | 0/0 |
| 5 | Control | " | 0/0 |
| 6 | Control | " | 0/0 |
| 7 | Control | " | 0/0 |
| 8 | Control | " | 0/0 |

The absence of a decolorized zone indicates the lack of lysed cells and absence of a cytotoxic response.

EXAMPLE VI

Effervescent Enzyme Tablets

Effervescent enzyme cleaning tablets are made by first preparing an effervescent excipient containing sodium bicarbonate, citric acid and sodium chloride in a weight ratio of 3:1:1. Each of the salts is finely ground separately in a mortar and then mixed together with the aid of a mortar and pestle. A small amount of distilled water e.g. . . . ≦0.5 ml is added to the mixture and further blended to initiate molecular interaction of the salts. The mixture is spread evenly on a glass plate and placed in a vacuum oven for 2 to 3 hours at 60° C. The mixture is then finely ground in a mortar and blended with Enzeco Protease AP I enzyme powder in a ratio of excipient to enzyme of 2:1 to provide 100 mg of enzyme per tablet. Tablets are then made by compressing at 2500 psig.

The above tablets are then tested for dissolution time; solution appearance and effervescence characteristics. Dissolution in 10 ml of distilled water requires 37 seconds; a white foam appears initially but settles shortly thereafter to provide a clear and colorless solution. Dissolution of the tablet occurred uniformly.

While the invention has been described in conjunction with specific examples thereof, this is illustrative only. Accordingly, many alternatives, modifications and variations will be apparent to those skilled in the art in light of the foregoing description, and it is therefore intended to embrace all such alternatives, modifications and variations as to fall within the spirit and broad scope of the appended claims.

What is claimed is:

1. A method of cleaning an extended wear contact lens, which comprises contacting the lens for less than 2 hours with an effective amount of an activator-free, non-malodorous enzyme-containing solution comprising an aqueous solution containing a protease prepared by dissolution in aqueous solution of a contact lens cleaning tablet comprising from about 0.01 mg. to about 500 mg. of a protease derived from a Bacillus, Streptomyces, or Aspergillus microorganism.

2. The method of claim 1 wherein the lens is contacted with the solution for a period of time from 30 minutes to 1 hour.

3. The method of claim 1 wherein the protease is derived from *Bacillus licheniformis.*

4. The method of claim 1 wherein the protease is derived from *Bacillus subtilis.*

5. The method of claim 1 wherein the protease is derived from *Aspergillus oryzae.*

6. The method of claim 1 wherein the protease is derived from *Streptomyces griseus.*

7. The method of claim 1 wherein the enzyme-containing solution is prepared from an effervescent tablet.

8. The method of claim 1 wherein the enzyme-containing solution is prepared from a non-effervescent tablet.

* * * * *